US007347301B2

(12) United States Patent
Sekiya et al.

(10) Patent No.: US 7,347,301 B2
(45) Date of Patent: Mar. 25, 2008

(54) LUBRICANT SUPPLY SYSTEM AND OPERATING METHOD OF MULTISYSTEM LUBRICATION SCREW COMPRESSOR

(75) Inventors: Yoshimitsu Sekiya, Moriya (JP); Kiyoshi Tanaka, San Paulo (BR); Shuji Fukano, Wako (JP); Hironori Nakai, Nagareyama (JP); Yoshifusa Kubota, Moriya (JP); Teiji Shozu, Jyoso (JP)

(73) Assignee: Mayekawa Mfg. Co., Ltd. (JP)

( * ) Notice: Subject to any disclaimer, the term of this patent is extended or adjusted under 35 U.S.C. 154(b) by 0 days.

(21) Appl. No.: 11/670,673

(22) Filed: Feb. 2, 2007

(65) Prior Publication Data

US 2007/0163840 A1 Jul. 19, 2007

Related U.S. Application Data

(63) Continuation of application No. PCT/JP2004/011412, filed on Aug. 3, 2004.

(51) Int. Cl.
*F01M 1/00* (2006.01)

(52) U.S. Cl. ..... 184/6.16; 184/6.21; 184/6.23; 184/6.24

(58) Field of Classification Search ..... 184/6.16, 184/6.21, 6.22, 6.23, 6.24
See application file for complete search history.

(56) References Cited

U.S. PATENT DOCUMENTS 4,063,855 A * 12/1977 Paul ..... 418/84
5,318,151 A * 6/1994 Hood et al. ..... 184/6.1
6,474,953 B2 * 11/2002 Van De Putte ..... 417/44.2
RE38,434 E * 2/2004 Jennings ..... 137/14
7,059,837 B2 * 6/2006 Nichol et al. ..... 417/201

FOREIGN PATENT DOCUMENTS

| | | | |
|---|---|---|---|
| JP | 52-41480 | U | 3/1977 |
| JP | 57-135292 | A | 8/1982 |
| JP | 58-107888 | A | 6/1983 |
| JP | 60-105887 | U | 7/1985 |
| JP | 63-130686 | U | 8/1988 |
| JP | 2002-317782 | A | 10/2002 |
| JP | 2003-097558 | A | 4/2003 |

OTHER PUBLICATIONS

Relevant Portion of International Search Report issued in corresponding International Application No. PCT/ JP2004/011412 (from which this Present Application claims domestic priority), with mailing date Dec. 7, 2004.

* cited by examiner

*Primary Examiner*—David M. Fenstermacher
(74) *Attorney, Agent, or Firm*—Rossi, Kimms & McDowell LLP

(57) ABSTRACT

An oil refrigeration screw compressor being applied to a refrigeration system etc., in which the problem of strength reduction of a bearing material under high temperatures and that of lifetime reduction of the bearing material due to viscosity lowering of lubricant are solved. A lubricant supply system to a compressor body is divided into a bearing oil supply system for supplying lubricant to each bearing of the compressor body at low pressure and into a temperature control oil supply system for supplying lubricant into the compressor body at high pressure. The bearing oil supply system is a closed circuit oil supply system comprising an oil supply tank, an oil cooler, and an oil supply pump, and the temperature control oil supply system is a closed circuit oil supply system comprising an oil separator and an oil cooler.

11 Claims, 5 Drawing Sheets

(A)

(B)

(C)

LUBRICANT SUPPLY SYSTEM AND OPERATING METHOD OF MULTISYSTEM LUBRICATION SCREW COMPRESSOR

This is a continuation of International Application PCT/JP2004/011412 (published as WO 2006/013636) having an international filing date of 3 Aug. 2004, the contents of which is incorporated by reference herein.

TECHNICAL FIELD

The present invention relates to a lubricant supply system of a screw compressor having multi-lubricating system with which problems of reduction in strength of bearing material under high temperature and reduction in lifetime of the bearing material due to lowering in viscosity of lube oil through separating the lube oil supply system to the compressor into an injection-supply line for supplying lube oil to the rotors of the compressor and a supply line for supplying lube oil to the bearings of the compressor, in an oil-cooled screw compressor, for example, used for refrigerating system, and an operating method of the compressor.

BACKGROUND ART

Previously, an oil-cooled screw compressor was composed such that, lube oil supplied through an injection-supply line for the purpose of sealing the clearance between the male and female rotors and the clearance between the casing and the rotors, and lube oil supplied through a supply line for lubricating the bearings join together in the rotor room where sucked gas is being compressed, and the interflowed lube oil is discharged together with the compressed gas. Therefore, lube oil of the same kind have to be supplied to both the supply lines, because lube oil supplied to each line mixes with each other in the rotor room.

When compressing high condensable gas such as high hydrocarbon group gas and water-saturated natural gas of relatively high boiling point, which are highly soluble in lube oil, synthetic lube oil of high viscosity was used as lubricant with its supply amount reduced and its temperature raised. Or the compressor was operated under high temperature by adopting separate supply of lube oil to rotor bearings. The reason of operating under high temperature is to keep the temperature of compressed fluid discharged from the compressor higher than its dew point and to reduce solubility of the compressed fluid in lube oil.

However, operation of the compressor under high temperature causes reduction in strength of bearing material due to heat generation by sliding in rotor bearings or reduction of lifetime of bearings due to lowering in viscosity of lube oil. To solve the problem, it is demanded to develop bearing material of high heat tolerance, but no bearing material superior than white metal has been commercially available as of now as far as economical efficiency and reliability are concerned.

Further, synthetic lube oil has hydrophilic property, and when water or active ingredient was contained in fluid f to be compressed, hydrolysis cleavage or corrosion of bearing material occurred.

In Japanese Laid-Open Patent Application No. 2003-97558 is disclosed material of lubricating part of low friction superior in lubricity and not apt to be seized, in which at least one of two friction surfaces of material bodies contacting one another via lubricant containing a compound having a hydrophilic radical and hydrophobic radical in its molecules, is formed of a micro-phase-separated surface of a compound 1 and the other friction surface is formed of a hydrophilic surface. With the construction of the bearing part, an adsorption film which is hardly torn away is formed on the friction surfaces (particularly on the friction surface of the compound 1), so bearing seizure is not apt to occur. In addition to this, as both the adsorption films are poor in conforming to each other, friction surfaces superior in lubricity can be obtained.

However, in a screw compressor used in a refrigerating system or compression system using as a refrigerant a highly soluble gas which is highly soluble in lube oil, such as high condensable gas having relatively high boiling point, wear resistance of bearings deteriorates rapidly when lube oil temperature exceeds 125° C., and operating life of the compressor is shortened. Abovementioned material of lubricating part does not necessarily provide a lubricating part superior in wear resistance under high temperature. Further, when aluminum alloy or silver is adopted as bearing material, running-in property is not good and bearing seizure is apt to occur.

To solve the problems mentioned above, it may be considered to control temperature and pressure around the bearings taking into consideration the relation between viscosity and temperature depending on dissolution percentage of refrigerant gas dissolved in the lube oil as shown in FIG. 5, and relation between dissolution percentage of refrigerant gas dissolved in lube oil and temperature depending on pressure as shown in FIG. 6. It is recognized from FIG. 5 and FIG. 6 that, the amount of dissolution of refrigerant gas in lube oil decreases when temperature is raised and pressure is decreased, and that viscosity of lube oil lowers with decreased pressure. Therefore, by increasing temperature and decreasing pressure of lube oil supplied, the lube oil is maintained in a high viscosity and necessary thickness of oil film for lubrication can be maintained, so it is expected to prolong the lifetime of the bearings. However, there is a restriction to increasing temperature that, when the temperature of lube oil is raised, occurrence of bearing seizure and reduction of bearing life are induced. As to pressure, there is a restriction that pressure of lube oil injected into the rotor room must be high than a certain pressure, for when supply pressure of lube oil to the balance piston to reduce thrust force exerting on the male rotor from discharge side toward suction side, the thrust load of the thrust bearing increases resulting in reduced life of the thrust bearing.

DISCLOSURE OF THE INVENTION

The present invention was made in light of aforementioned problems, and an object of the invention is to provide a lubricant supply system of a screw compressor and operating method thereof, with which reduction in strength of the rotor bearings, occurrence of bearing seizure, and reduction in wear resistance of the bearings can be prevented and bearing life is prolonged without reducing overall performance of the screw compressor.

Another object of the invention is to provide a lubricant supply system, with which the lube oil flow for lubricating the rotor bearings can be minimized, discharge gas temperature compressed by the compressor can be maintained at high temperature, and lube oil for lubricating the bearings can be supplied in a temperature lower than a permissible temperature for the bearings, which enables adoption of low viscosity oil.

A further object of the invention is to provide a lubricant supply system, with which constituent devices such as oil separator can be small sized, separation efficiency of the oil separator can be increased, and intrusion of foreign matter contained in fluid to be compressed into lube oil can be minimized.

To attain the objects, the present invention proposes a lubricant supply system of a screw compressor having a multi-lubricating system, wherein said system for supplying lube oil to the compressor is divided into a bearing oil supply system for supplying lube oil to bearings of the compressor at low pressure and a temperature control oil supply system for supplying lube oil into the compressor at high pressure to control temperature of fluid compressed in the compressor by allowing the lube oil to contact the fluid, said bearing oil supply system being a closed oil supply line provided with an oil supply tank, an oil cooler, and an oil supply pump, said temperature control oil supply system being a closed oil supply line provided with an oil separator and an oil cooler.

In the invention, by dividing the lubricant supply system into a bearing oil supply system of closed circuit and a temperature control oil supply system of closed circuit, optimum operation condition (temperature, pressure, and minimum requisite oil supply, for example) can be set for each of the systems, thereby the problems of prior art can be solved and aforementioned objects of the invention can be attained.

Lube oil for lubricating the bearings can be supplied to each of the bearings by means of an oil supply pump from the oil supply tank through the bearing oil supply system after cooled by the oil cooler in the system and reduced in viscosity. Therefore, occurrence of bearing seizure and reduction in wear resistance of the bearings can be prevented with the result that bearing life is prolonged.

In a conventional oil-cooled screw compressor, lube oil at discharge gas pressure is sucked and introduced to a space of near suction gas pressure, so lube oil supply is determined by pressure difference between the discharge and suction gas pressure. However, minimum requisite amount of lube oil supply for the practical purpose in each of oil supply lines often differs from the amount determined by the pressure difference.

Injection oil supply via the temperature control oil supply system is intended to increase volumetric efficiency by the effect of sealing the clearance between the rotors and clearance between the rotors and rotor casing, and to increase polytropic efficiency of compression by cooling the gas in the process of compression. Whereas, bearing oil is intended to lubricate the bearings, and the smaller the amount of lube oil supply is, the better the mechanical efficiency of the compressor, for the power for supplying lube oil is reduced.

In the conventional screw compressor, lube oil flow is such that injection oil is supplied through an injection oil supply line branched from a bearing lubricating oil supply line, oil supplied through both lines to the compressor is discharged from the discharge port together with the compressed gas, then separated from the gas in an oil separator, as mentioned before. The separated lube oil which is raised in temperature to the temperature of the discharge gas is cooled by an oil cooler to a proper temperature, passes through an oil filter, and again supplied to the compressor. Thus, in the conventional screw compressor, injection supply oil and bearing lubricating oil are supplied at the same pressure and temperature, and the amount of supply can not be controlled separately.

According to the invention, injection oil supplied to the rotor room can be raised in temperature or decreased in flow rate for the purpose of preventing occurrence of condensation of compressed fluid, so the amount of lube oil mixed in the fluid can be reduced. Therefore, the oil separator in the temperature control oil supply system (injection oil supply line) can be small sized and oil separation efficiency can be increased. Further, intrusion of foreign matter contained in the fluid to be compressed into lube oil can be suppressed to the minimum. On the other hand, the amount (flow rate) of lube oil for lubricating rotor bearings can be reduced to the minimum and its temperature can be lowered below permissible temperature for bearing lubrication. Therefore, it is made possible to adopt low viscosity lube oil and also to maintain the compressed gas in high temperature without excessively cooled by lube oil.

In the invention, it is preferable that said bearing oil supply system is provided with a path for recovering the lube oil supplied to the bearings of the compressor to said oil supply tank, and said temperature control oil supply system is provided with a path for supplying to said oil supply tank a part of the lube oil flowed through said oil separator and said oil cooler.

This makes it possible that lube oil supplied through both the oil supply systems including leaked oil between both the systems is recovered finally to the oil supply tank in the bearing oil supply system, and that some leakage of lube oil between both the systems is acceptable. By the way, as lube oil supplied through both the systems mixes with each other, the same lube oil must be used for both the systems.

In the invention, it is preferable that said bearings for supporting rotatably rotors of the compressor are slide bearings each having a circumferential groove along inner periphery thereof for accumulating lube oil supplied to the bearings so that the lube oil accumulated in said groove is recovered to a low pressure lube oil recovery path.

This makes it possible that lube oil supply and recovery to and from the rotor bearings are made easy and certain, and that some degree of oil leakage from the bearing clearances to the rotor room or from the rotor room to the bearing clearances is acceptable, thereby the leakage being able to be restricted to a moderate degree. The leakage can be suppressed by allowing the lube oil to be accumulated in the grooves and recovered to the low pressure lube oil recovery path.

In the case the lube oil leakage is large due to large pressure difference between both the oil supply systems, it is effective to provide oil seals or mechanical seals between the rotor end faces and the slide bearings.

In the invention, it is preferable that a path is provided for communicating the gas zone in the upper part in said oil supply tank to a position near a suction port of the compressor for sucking fluid to be compressed and a pressure regulator valve is provided to said path.

This makes it possible to prevent rapid rise of pressure in the oil supply tank in the bearing oil supply system at the start of operation of the compressor by controlling the pressure regulator valve so that the pressure of the gas zone in the upper part in the oil supply tank is equalized as far as possible to suction pressure of the gas to be compressed or to a medium pressure, and to inject oil to the rotor room by pressure difference between the discharge and suction pressure of the compressor.

Although the lube oil supply system is composed such that the lube oil supplied through the temperature control oil supply system does not mix with the lube oil supplied through the bearing oil supply system when the compressor is not operated, it may occur by possible leakage of lube oil between both the systems during operation of the compressor that pressure in the oil supply tank in the bearing oil supply system rises to the same pressure as that of the temperature control oil supply system, i.e. the discharge pressure of the compressor, as a result, when operation is restarted, pressure in the oil supply tank is remained high.

To deal with this, it is preferable that a branch path is provided for returning lube oil to said oil supply tank in the downstream of said oil supply pump in said bearing oil supply system, a pressure regulator valve is provided to said branch path, and a controller is provided which controls opening of said pressure regulator valve based on pressure difference between oil pressures in the downstream and upstream of said oil supply pump in said bearing oil supply system and on pressure difference between discharge gas pressure in said temperature control oil supply system and oil pressure in the downstream of said oil supply pump. By this, rapid rise of pressure in the lube oil recovery path at restarting operation of the compressor can be moderated.

Low pressure of bearing lube oil supply is permissible when the screw compressor is operated under light load, but minimum requisite flow rate must be secured for each of the bearings.

In the case of a screw compressor provided with a balance piston, pressure required for the balance piston is determined by the difference of bearing oil supply pressure and suction gas pressure in the temperature control oil supply system.

It is preferable that an oil-level meter is provided to said oil supply tank in said bearing oil supply system, a path is provided for returning oil from said oil supply tank to said temperature control oil supply system, a flow regulator valve is provided to said path, further in said temperature control oil supply system a flow regulator valve is provided to said path for supplying a part of the lube oil flowed through said oil separator and said oil cooler to said oil supply tank, and a controller is provided which controls the oil level of said oil supply tank in a range of prescribed level by controlling each of said flow regulator valves based on detected value of said oil-level meter.

By this, the oil level in the oil supply tank can kept to be in a prescribed range and variation of the oil level due to leakage of oil between the bearing oil supply system and temperature control oil supply system, etc. can be suppressed.

Further, it is preferable that a branch path bypassing said oil cooler is provided in said bearing oil supply system, that a temperature control valve is provided to said branch path to control lube oil temperature, and that temperature of the lube oil supplied to the bearings is controlled by controlling opening of said temperature control valve.

By this, lube oil low in temperature and high in viscosity can be supplied to the rotor bearings.

It is also preferable that, in the case the compressor is provided with a balance piston, said bearing oil supply system is divided into an oil supply line for supplying oil to the balance piston and an oil supply line for supplying oil to the bearings, and a flow regulator valve is provided to said oil supply line for supplying oil to the bearings.

A control operator is provided which controls pressure of oil to be supplied to said balance piston so that requisite counter force is applied to the balance piston by said oil pressure, whereby said requisite counter force is determined by calculating the thrust force exerting on the male rotor based on the discharge gas pressure and suction gas pressure.

This makes it possible to always maintain oil supply pressure requisite respectively for the balance piston and the rotor bearings.

In the invention, it is preferable to operate the screw compressor by a method in which lube oil supplied to the compressor through said temperature control oil supply system is increased in temperature or decreased in flow rate and lube oil supplied to the bearings of the compressor through said bearing oil supply system is cooled by said oil cooler to be increased in viscosity.

By this, the problems in the prior art mentioned before, that is, reduction in strength of bearing material due heat generation by friction in the slide bearings and reduction of bearing life due to decreased viscosity of bearing lube oil can be prevented.

It is also preferable to operate the screw compressor by a method with which a gas zone in the upper part in said oil supply tank is maintained at the same pressure as suction pressure of the compressor or intermediate pressure between suction and discharge pressure.

This makes it possible to produce pressure difference between the discharge pressure of the compressor and the oil supply pressure of the bearing lubricating oil supply line, and to adopt oil supply by pressure difference in operation to inject oil into the rotor room toward the rotors by pressure difference between the discharge and suction pressure of the compressor. Further, by maintaining the pressure of gas zone in the upper part in the oil supply tank to be the same as suction pressure or intermediate pressure between suction and discharge pressure, abnormal rise in pressure in the bearing lubricating oil supply system can be prevented.

BEST MODE FOR EMBODIMENT OF THE INVENTION

Preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
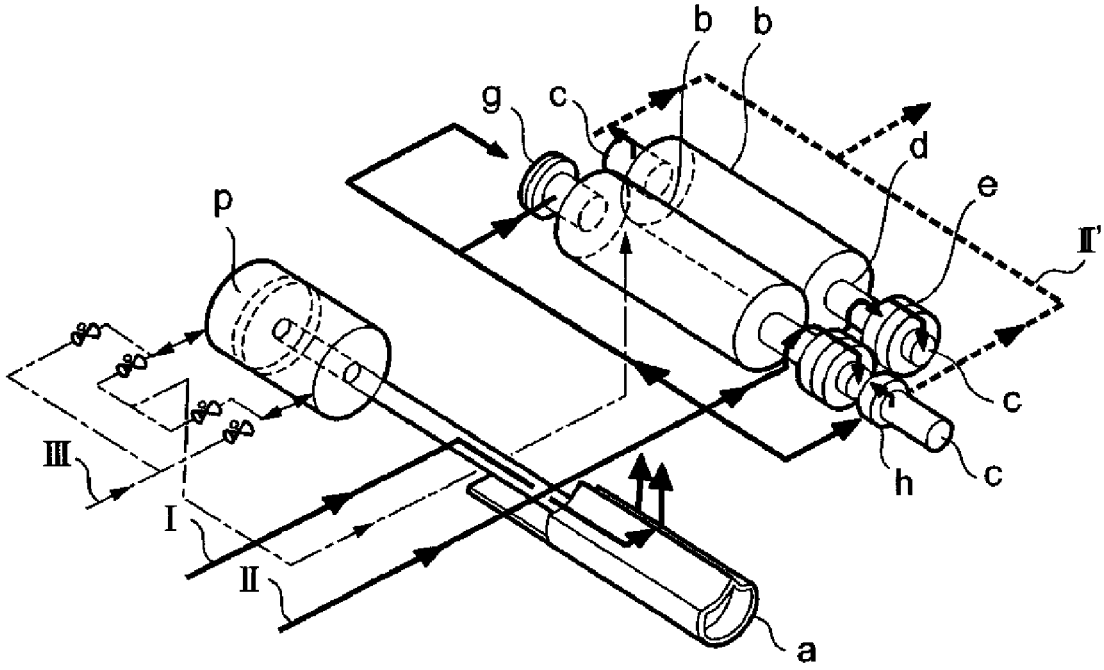
FIG. 1 is a schematic illustration of an example of lube oil supply line of the screw compressor according to the present invention in a perspective view.

FIG. 1 is a schematic illustration of an example of lube oil supply line of the screw compressor according to the present invention in a perspective view.

In FIG. 1, reference numeral I is an oil supply line for controlling temperature, lube oil is supplied through this line to be injected from a slide valve toward screw rotors b consisting of a male rotor and a female rotor in order to control temperature of the compressed fluid discharged from the compressor together with the compressed fluid. Reference numeral II is a bearing lubricating oil supply line, lube oil is supplied through this line to sleeve bearings d and thrust bearings e of rotor shafts c, to a balance piston g for reducing thrust load, and to an oil seal h, and flows out to a return path II' which communicates to an oil supply tank not shown in the drawing.

Reference numeral III is an oil supply line for supplying oil to a hydraulic piston p for driving the slide valve a. This line is a closed line provided separately from the line I and II which are related to the present invention, The line III is not related to the invention, so explanation is omitted.

By providing the oil supply lines I and II separately from each other in the invention, the compressor can be operated at optimal conditions concerning temperature, pressure, and flow rate of lube oil supplied via each of the oil supply lines, and the objects of the present invention can be attained.

Figure 2:
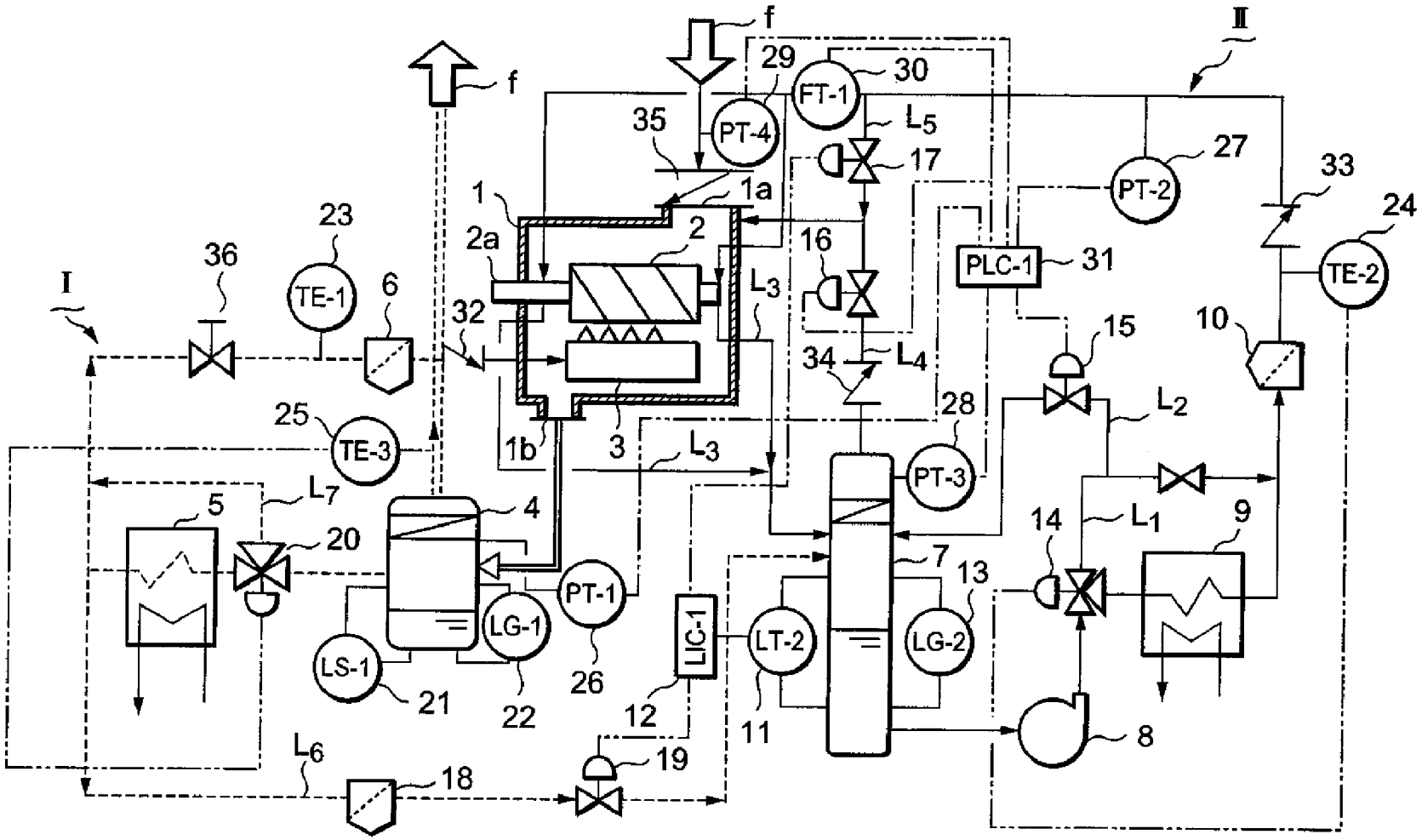
FIG. 2 is a total block diagram of the first embodiment of lube oil supply system of screw compressor according to the present invention.

Next, in FIG. 2 showing the lube oil supply system of the first embodiment of the invention, reference numeral 1 is a screw compressor, 2 is a screw rotor of a pair of male and female screw rotors supported rotatably in the rotor casing of the compressor 1, 3 is a slide valve for injecting lube oil to the rotor 2 in the rotor casing. Reference numeral 1*a* is a suction port of fluid f to be compressed, 1*b* is a discharge port of compressed fluid f, and 2*a* is a shaft part of the rotor 2.

The fluid f to be compressed is sucked from the suction port 1*a* into the compressor 1 and compressed as the rotors 2 rotate to be discharged in a pressurized state together with lube oil mixed in it. The mixed lube oil is separated from the compressed gas in an oil separator 4. The separated lube oil is cooled in an oil cooler 5, filtered through a filter 6 to remove foreign matter, and again returned to the slide valve 3. This closed circulation circuit composes the temperature control, oil supply line I and shown by a broken line.

Reference numeral 7 is an oil supply tank in which lube oil is reserved, the oil reserved in the oil supply tank 7 is supplied by means of an oil supply pump 8 to rotor bearing parts of the compressor via an oil cooler and a filter 10. The lube oil supplied to the rotor bearing parts is recovered to the oil supply tank 7 passing through a return path $L_3$. This closed circuit composes the bearing lubricating oil supply line II and shown by a solid line.

The oil supply tank 7 is provided with a liquid-level meter 13 for detecting oil levels and a liquid level transmitter 11 for sending oil levels detected by the liquid-level meter 13 to an oil-level control operator 12. A temperature control valve 14 is provided in the upstream of the oil cooler 9, a branch path $L_1$ branches from the temperature control valve 14, and a branch path $L_2$ equipped with a pressure regulator valve 15 branches from the branch path $L_1$ for allowing a part of the lube oil from the oil supply pump 8 to be returned to the oil supply tank 7. A path $L_4$ is provided which communicates the gas zone in the upper part of the oil supply tank 7 to a position near the suction port 1*a*, a pressure regulator valve 16 is provided in the path $L_4$, and a path $L_5$ having a flow regulator valve 17 is provided for allowing the lube oil in the oil supply line II to be supplied to the position near the suction port 1*a*.

A path $L_6$ is provided to the temperature control oil supply line I for supplying a part of the lube oil to in the line to the oil supply tank 7, and a filter 18 and a flow regulator valve 19 are provided in the path $L_6$. A temperature control valve 20 is provided in the downstream of the oil cooler 5, and a path $L_7$ branches from the temperature control valve 20. The oil separator 4 is provided with a liquid-level meter 22 for detecting oil levels and a liquid-level switch 21 for allowing an alarm to be sounded when the detected oil level has lowered to a limit level. Reference numerals 23, 24, and 25 are temperature detectors for detecting and transmitting signals of detected temperatures, and reference numeral 26, 27, 28, and 29 are pressure detectors for detecting pressure and transmitting signals of detected pressures provided to each of the paths respectively. Reference numeral 30 is a flow detector, 31 is a control operator for determining oil pressure adequate or optimal for the bearing lubricating oil supply line II based on the pressure difference between the upstream and downstream zone of the oil supply pump 8 and on the pressure difference between the temperature control oil supply line I and bearing lubricating oil supply line II, and for controlling the pressure regulator valve 15 so that said adequate oil pressure is realized in the bearing lubricating oil supply line II. Reference numerals 32, 33, 34, and 35 are non-return valves, and 36 is a manual valve.

FIG. 3A shows arrangement of rotors and bearing parts of the first embodiment shown in FIG. 1. In the drawing, lube oil injected into the rotor room to control temperature of compressed fluid f is indicated by I, and lube oil supplied to lubricate bearings is indicated by II. In FIG. 3A, reference numeral 2 is a pair of male and female rotors, each of the rotors 2 is supported by journal bearings 42 at its shaft parts 2*a* extending from both ends thereof. Reference numerals 41 are oil seals, 43 are thrust bearings. Reference numeral 44 is a mechanical oil seal. FIG. 3B and FIG. 3C are respectively an enlarged sectional view of the journal bearing indicated by an arrow B and arrow C in FIG. 3A.

In FIG. 3B and FIG. 3C, an oil groove 45, 46 is provided in each of the journal bearings for returning lube oil to the oil supply tank 7 via the oil return path $L_3$.

Journal bearings of this type may be used together with the oil seals 41 or without the oil seals 41.

In the first embodiment shown in FIG. 2 and FIG. 3A, lube oil supplied via the temperature control oil supply line I and via the bearing lubricating oil supply line II inevitably mix with each other, so preferably lube oil of the same kind is used for the lines I and II. Lube oil for controlling temperature can be injected into the rotor room by utilizing pressure difference between the discharge pressure at the discharge port 1*b* and the pressure in the rotor space under compression process.

As to temperature of oil, temperature of the oil supplied via the temperature control oil supply line I and that supplied via the bearing lubricating oil supply line II can be made different, for the two lines I and II are separate lines. It is effective, for example, to raise the temperature of the oil injected into the rotor room for temperature control in order to prevent occurrence of condensation of the gas compressed in the compressor by decreasing or stopping oil flow and decrease the temperature of the oil supplied to the bearings in order to secure proper viscosity of the lube oil. Herewith, aforementioned problems in the prior art, that is, reduction in strength of slide bearings due to heat generation by friction and reduction in bearing life due to lowering in viscosity of lube oil, can be prevented.

According to the embodiment, injection oil supplied to the rotor room can be raised in temperature or decreased in flow rate for the purpose of preventing occurrence of condensation of compressed fluid, so the amount of lube oil mixed in the fluid can be reduced. Therefore, the oil separator in the temperature control oil supply line I can be small sized and oil separation efficiency can be increased. Further, intrusion of foreign matter contained in the fluid f to be compressed to the bearing lubricating oil supply line II can be suppressed to the minimum. On the other hand, the amount (flow rate) of lube oil for lubricating rotor bearings can be reduced to the minimum and its temperature can be lowered below permissible temperature for bearing lubrication. Therefore, it is made possible to adopt low viscosity lube oil, for example, mineral oil, and also to maintain the compressed gas in high temperature without excessively cooled by lube oil.

Further, by providing the path $L_3$ in the bearing lubricating oil supply line II in order to recover the lube oil after lubricating bearings of the compressor 1 to the oil supply tank 7 and the path $L_6$ in the temperature control oil supply line I in order to supply a part of the lube oil separated in the oil separator 4 and cooled by the oil cooler 5, lube oil in both lines including lube oil leaked between both lines can be eventually recovered to the oil supply tank 7 in the bearing lubricating oil supply line II, so a little leakage between both lines is acceptable.

The same lube oil must be used for both lines, for lube oil in both lines mixes with each other.

Figure 3:
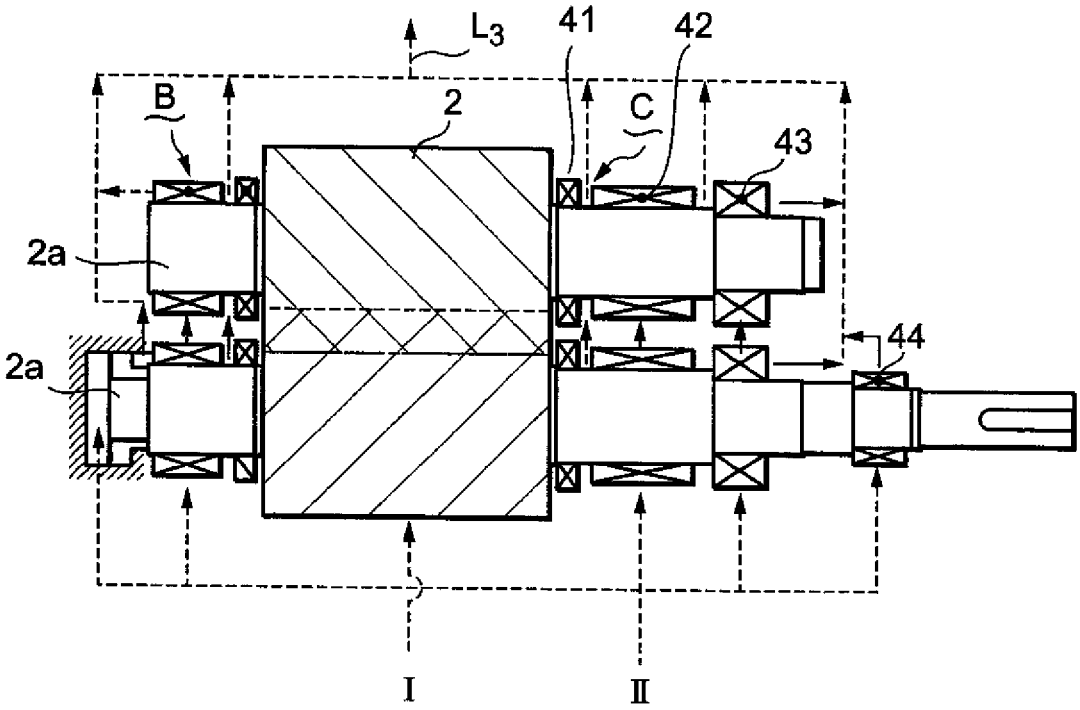
FIG. 3A is a drawing showing arrangement of rotors, bearings, etc. of the screw compressor.
FIG. 3B and FIG. 3C are longitudinal sectional views of journal bearings supporting the rotors.
Figure 3:
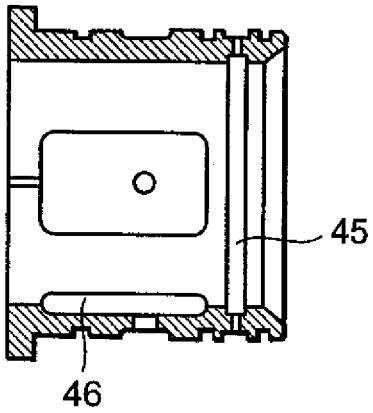
Figure 3:
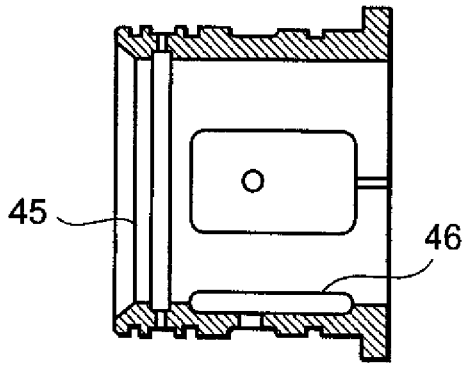

As shown in FIG. 3, by adopting slide bearings for supporting rotatably the rotors 2 and providing grooves 45 and 46 respectively near the rotor end face side end of each slide bearing to allow lube oil to be accumulated therein so that the lube oil accumulated in the groove is introduced to the lube oil recovery path $L_3$ of low pressure, supply and recovery of lube oil for lubricating the bearings can be performed easily and positively, and leakage of lube oil from bearing space into the rotor casing or on the contrary from the rotor casing into the bearing space can be suppressed to the minimum while allowing the leakage of a certain amount of lube oil. That is, leakage of lube oil can be suppressed by allowing lube oil to accumulate transiently in the grooves and recovering again to another low pressure lube oil recovering path. By this, lube oil leakage between both lines I and II can be minimized.

Further, by providing the path $L_4$ for communicating the gas zone in the oil supply tank 7 in the bearing lubricating oil supply line II to a position near the suction port 1*a* and attaching the pressure regulator valve 16 to the path $L_4$, pressure of the gas zone in the oil supply tank 7 in the bearing lubricating oil supply line II can be made to be at a pressure the same as suction pressure of fluid f to be compressed or intermediate pressure between suction and discharge pressure, so pressure rise in the oil supply tank 7 in the bearing lubricating oil supply line II when starting operation of the compressor 1 can be prevented, and it is made possible that oil injection into the rotor room can be performed by pressure difference between discharge pressure detected by the pressure detector (26) and suction pressure detected by the pressure detector (28), that is, oil supply by pressure difference in operation can be adopted.

Further, by providing the branch path $L_2$ for returning lube oil in the downstream of the oil supply pump 8 to the oil supply tank 7, attaching the pressure regulator valve 15 to the branch path $L_2$, and providing the control operator 31 for controlling the opening of the pressure regulator valve 15 based on the pressure difference between oil pressure in the downstream and upstream of the oil supply pump 8 (pressure difference between the pressure detected by the pressure detector 27 and that detected by the pressure detector 28) and the pressure difference between discharge gas pressure in the temperature control oil supply line I (pressure detected by the pressure detector 26) and oil pressure in the downstream of the oil supply pump 8 (pressure detected by the pressure detector 27), a rapid pressure rise in the lube oil recovery path $L_2$ when staring operation of the compressor can be alleviated.

Further, by providing the oil-level meter 11 to the oil supply tank 7 in the bearing lubricating oil supply line II, providing the path $L_5$ for returning lube oil from the oil supply tank 7 to the temperature control oil supply line I, providing the flow regulator valve 17 to the path $L_5$, providing the flow regulator valve 19 to the path $L_6$ in the temperature control oil supply line I to recover a part of lube oil to the oil supply tank 7, the flow regulator valves 17 and 19 being controlled based on the oil level detected by the oil-level meter 11, and providing the control operator 12 for controlling the level of the oil in the oil supply tank 7 in a predetermined range, the level of the oil in the oil supply tank 7 can be maintained in a prescribed range and variation of the oil level caused by oil leak between the bearing lubricating oil supply line II and temperature control oil supply line I etc. can be suppressed.

Further, by providing the branch path $L_1$ for allowing the lube oil discharged from the oil pump 8 to bypass the oil cooler 9 in the bearing lubricating oil supply line II, attaching the temperature control valve 14 for controlling lube oil temperature to the branch path $L_1$, and controlling temperature of lube oil supplied to the bearings of the rotors by controlling the opening of the temperature control valve 14, lube oil of low temperature and high viscosity can be supplied to the bearings of the rotors.

Further, by adopting an operating method with which the gas zone in the upper part of the oil supply tank 7 is maintained at the same pressure as suction pressure of the compressor 1 or intermediate pressure between suction and discharge pressure, pressure difference is produced between the discharge pressure of the compressor and the oil supply pressure of the bearing lubricating oil supply line II, and it is made possible to adopt oil supply by pressure difference in operation to inject oil into the rotor room toward the rotors by pressure difference between the discharge and suction pressure of the compressor, and by maintaining the gas pressure in the oil supply tank 7 to be the same as suction pressure or intermediate pressure between suction and discharge pressure, abnormal rise in pressure in the bearing lubricating oil supply line II can be prevented.

Although the valves 16, 17, and 19 are closed so that the lube oil in the temperature control oil supply line I does not mix with the lube oil in the bearing lubricating oil supply line II when operation of the system is halted, occurrence of oil leak from the rotor room to bearings can no be evaded, and it is thought that the pressure in the oil supply tank 7 becomes the same as pressure of process gas, i.e. discharge pressure of the fluid f. By controlling pressure difference between the pressure in the temperature control oil supply line I and that in the bearing lubricating oil supply line II, a rapid rise in oil pressure in the bearing lubricating oil supply line II can be prevented when the oil supply pump 8 is driven by starting operation of the system next time.

Further, the pressure regulator valve 16 is controlled so that pressure in the oil supply tank 7 gradually becomes a prescribed pressure in idle operation with a minimum load after starting of operation of the system.

In the embodiment, a balance piston is provided to avoid excessive thrust force from exerting on the thrust bearing, and when starting, the slide valve 3 is positioned at a low load position for reducing starting torque, so occurrence of excessive thrust force can be avoided even when pressure of oil supplied to the balance piston is low. Therefore, it is also possible to determine bearing lubricating oil pressure which is detected by the pressure detector 27 so that the flow rate of the oil is at a minimum necessary flow rate.

When oil pressure required to be supplied to the balance piston in ordinary operation, it will be effective to provide an oil supply line for supplying oil to the balance piston separately from the other bearing lubricating oil supply line. In such a case, the flow rate in the other bearing lubricating oil supply line is controlled for securing a minimum necessary flow of lube oil.

When starting operation, it is supposed that there exists no lube oil in the rotor room. As oil injection into the rotor room by pressure difference between discharge pressure and suction pressure of the compressor, a state of no lubrication occurs in the rotor room although for a short period at the start of operation of the compressor. Therefore, heat generation is feared to occur by the contact of the male rotor with female rotor unless the compressor is of a type in which engagement of the rotors is defined by timing gears, so it is suitable to open the flow regulator valve 17 a little when starting.

In order to minimize leakage of high-pressure gas and oil from the rotor room to the bearing lubricating oil supply line II just after halting operation of the compressor, it is also effective to provide a non-return valve or automatic valve between the screw compressor and the oil separator 4 so that high pressure gas does not intrude into the inside of the compressor as far as possible.

All of the oil supply lines are basically closed circuits although oil leak may occur between each of the lines, oil levels in the oil supply tank 7 and oil separator 4 can be controlled by controlling the flow regulator valves 17 and 19 by the oil-level control operator 12.

However, in an open cycle of compressing gas by a screw compressor, the oil in the injection oil supply line reduces in amount by little and little and will eventually be exhausted, for a part of the oil is sent out of the line together with the compressed gas. When the oil in the injection supply line is exhausted, there is no choice but to supply oil from the bearing lubricating oil supply line II by opening the flow regulator valve 19. When operating continuously, some amount of oil leaking from the bearings into the rotor room can be expected to serve as injected oil, and it is thought that operation may be able to be continued even if oil is deleted in the temperature control oil supply line I. However, as to the bearing lubricating oil supply line II, deletion of oil is not permissible.

Therefore, as to control by the control operator 31, it is effective in ordinary continuous operation that the control of the level of oil in the oil supply tank 7 is performed preferentially by the control operator 12.

There is a way to provide a lower limit alarm as to the amount of oil in the injection oil supply line I , but since the injection oil supply exercises an effect only on discharge gas temperature of the compressor, operation of the compressor is stopped by the trip of excessive high temperature when the discharge gas temperature is higher than a prescribed temperature.

Figure 4:
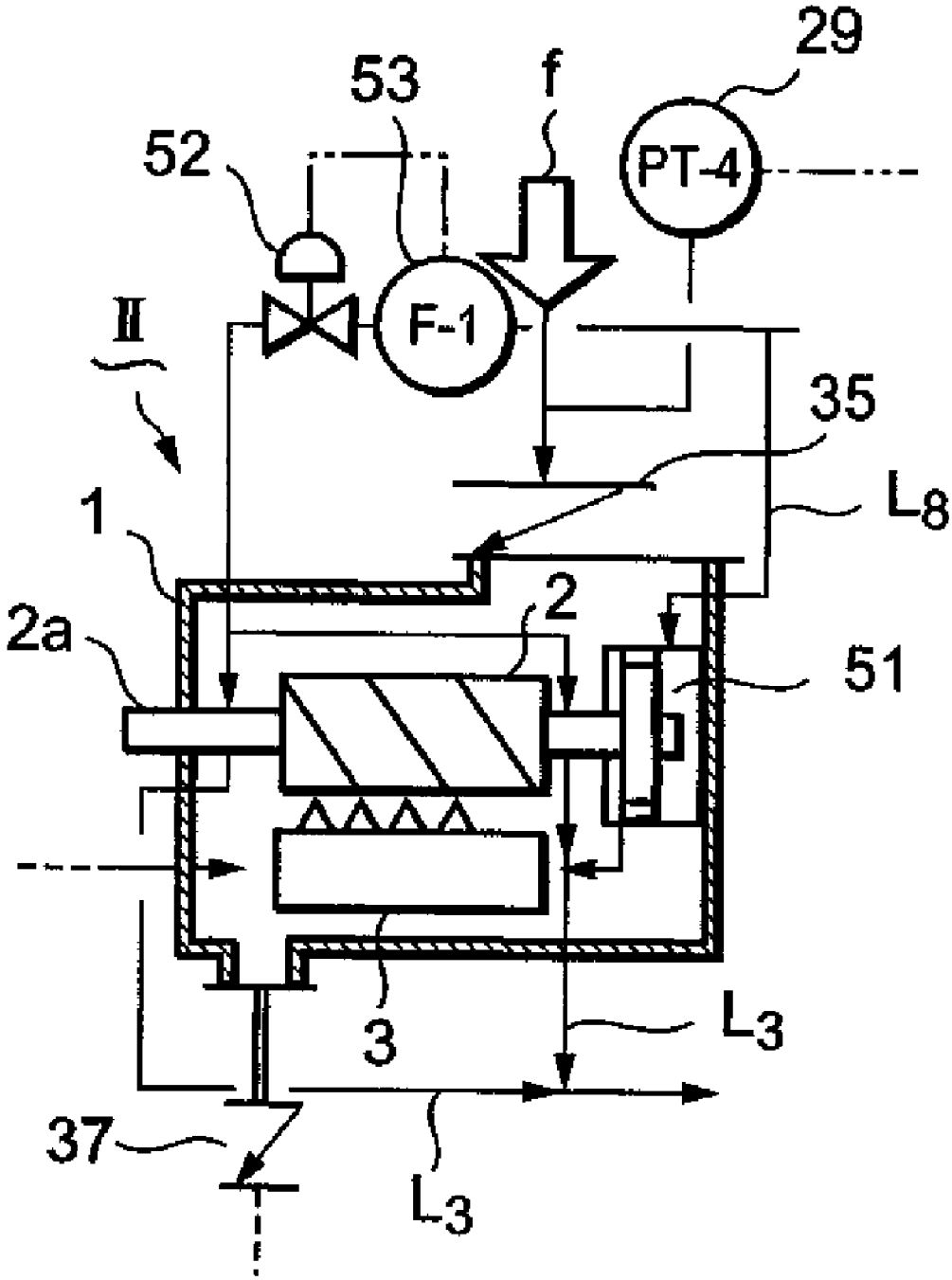
FIG. 4 is a partial block diagram of the second embodiment of lube oil supply system of screw compressor according to the present invention.
Figure 5:
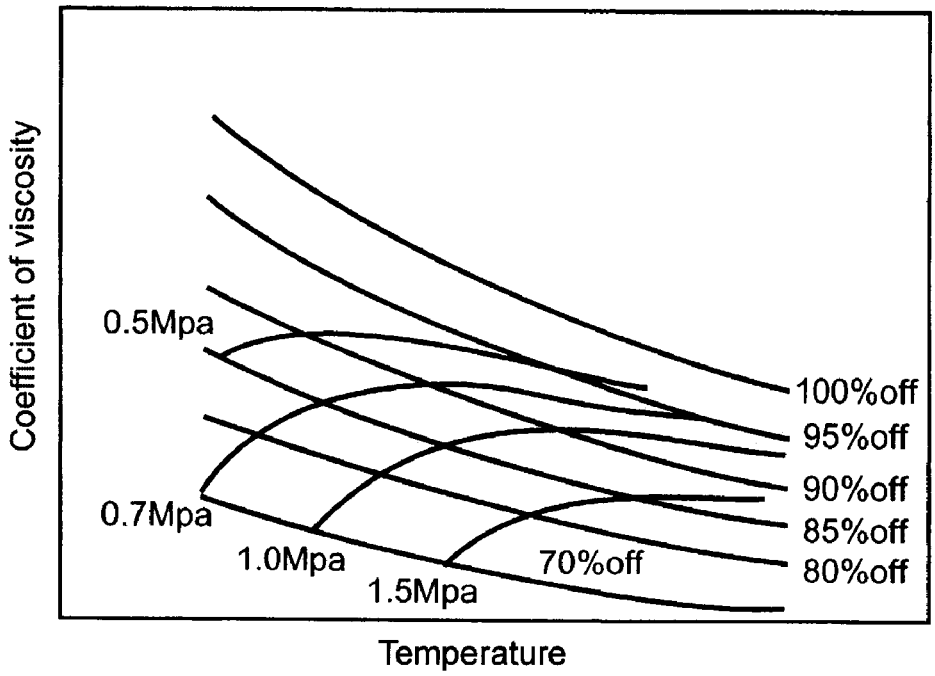
FIG. 5 is a graph showing relation between viscosity and temperature depending on dissolution percentage of refrigerant gas dissolved in the lube oil.
Figure 6:
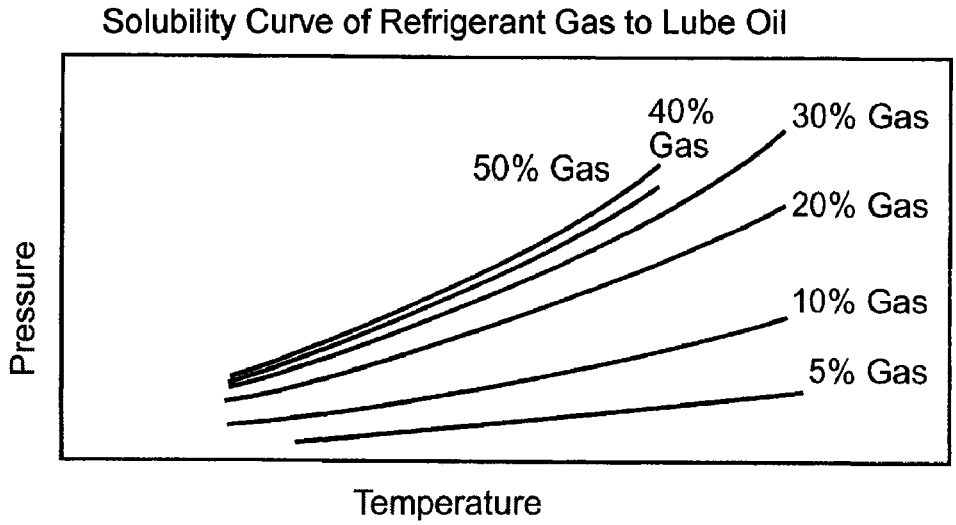
FIG. 6 is a graph showing relation between dissolution percentage of refrigerant gas dissolved in lube oil and temperature depending on pressure.

FIG. 4 is a partial block diagram of the second embodiment of lube oil supply system of screw compressor according to the present invention. In FIG. 4, the same instruments and parts as sown in FIG. 2 and FIG. 3 are indicated by the same reference numerals.

In FIG. 4, a path $L_8$ is an oil supply path branching from the bearing lubricating oil supply line II in order to supply oil to a balance piston 51, reference numeral 52 and 53 are respectively a flow regulator valve and a flow detector for detecting flow rates and transmitting signals of detected flow rates provided to the bearing lubricating oil supply line II. Construction except those instruments and parts that are added is the same as that of the first embodiment.

In the second embodiment, oil to be supplied to the balance piston 51 and oil to be supplied to bearings and oil seals are pressurized by the oil supply pump 8, and the pressurized oil supply is divided in two lines so that high-pressure oil is supplied to the balance piston which require high-pressure oil supply and oil reduced in pressure is supplied to bearings/oil seals to which the amount of oil supply is important rather than pressure.

Pressure control after pumping up by the oil supply pump 8, that is, pressure control of oil supply to the balance piston 51 is performed by the control operator 31 which calculates first the thrust force exerting on the male rotor based on the discharge gas pressure detected by the pressure detector 26 and suction gas pressure detected by the pressure detector 29, then determines requisite counter force to be applied to the balance piston 51, and controls the pressure of the oil supplied to the balance piston by controlling the pressure control valve 15 so that the requisite counter force is applied to the balance piston by the pressure of the oil supplied to the balance piston.

The flow of oil supplied to the bearings/oil seals is controlled by adjusting the flow regulator valve 52 so that the flow rate detected by the flow detector 53 is always necessary flow rate.

When the compressor is operated at a light load, lower bearing lubricating oil pressure is acceptable but minimum requisite oil flow rate must be secured.

According to the second invention, by dividing the bearing lubricating oil supply line II into two lines, i.e. the oil supply line $L_8$ to supply oil to the balance piston 51 and the other line to supply oil to bearings/oil seals, and providing the flow regulator valve 52 to said other line to supply oil to bearings/oil seals, proper oil pressure and proper oil flow rate can always be maintained respectively for the balance piston and bearings/seals. When oil pressure requisite for the balance piston 51 (pressure difference of detected pressures by the pressure detector 26 and 27) is the minimum, that is, when necessary oil flow to the balance piston does not exceed the minimum requisite oil flow to the bearings/oil seals, the flow regulator valve 52 is controlled so that the flow rate detected by the flow detector 53 is above prescribed lower limit value.

INDUSTRIAL APPLICABILITY

According to the invention, by dividing lubricant supply system for supplying lubricating oil to a screw compressor used, for example in a refrigerating system, into a low-pressure lube oil supply line for supplying lube oil to bearings of the compressor and a high-pressure temperature control oil supply line for controlling temperature of the gas compressed in the compressor by contacting with the fluid in the compression process in the compressor, lube oil for lubricating the bearings is supplied continuously to each of the bearings of the compressor by an oil supply pump from an oil supply tank via an oil cooler in a state it is cooled and increased in viscosity through the oil cooler. Therefore, occurrence of sticking and reduction in wear resistance of the bearings can be prevented and lifetime of the bearings can be prolonged.

Further, a lube oil supply system can be attained, with which the amount of lube oil for lubricating the bearings of the rotors can be minimized, discharge temperature of the gas compressed by the compressor can be allowed to be high, lube oil for lubricating the bearings can be supplied in a temperature lower than that permissible for the bearings, and lubrication of the bearings can be done with lube oil of low pressure and low viscosity.

Further, component instruments such as oil separator can be small sized, oil separation efficiency can be improved, and intrusion of foreign matter contained in the fluid to be compressed into lube oil can be minimized.

Furthermore, it is made possible to alleviate rapid rise in lube oil pressure in the bearing lubricating oil supply line when starting operation of the compressor by preventing excessive pressure rise in the oil supply tank in the bearing lubricating oil supply line when starting the operation, and injection of oil into the rotor room can be made by the pressure difference between the discharge pressure and suction pressure of the compressor.

In the case a balance piston is provided, requisite oil supply pressure can be maintained always for the balance piston and each of the bearings respectively.

The invention claimed is:

1. A lubricant supply system for a screw compressor having a slide valve, screw rotors, bearings for rotatably supporting the screw rotors, a first inlet for introducing gas to be compressed, and second and third inlets for separately introducing lube oil, the lubricant supply system comprising:

a bearing oil supply system that supplies lube oil to the bearings of the screw rotors at low pressure via the second inlet;

a temperature control oil supply system that supplies the lube oil into the the slide valve to supply the lube oil to the screw rotors at high pressure via the third inlet to control the temperature of compressed fluid being discharged from the compressor by contact with the lube oil, wherein the bearing oil supply system includes a closed oil supply line with an oil supply tank, an oil cooler, and an oil supply pump, and wherein the temperature control oil supply system includes a closed oil supply line with an oil separator and an oil cooler.

2. The lube oil supply system according to claim 1, wherein the bearing oil supply system includes a first path for recovering the lube oil supplied to the bearings of the compressor to the oil supply tank, and the temperature control oil supply system includes a second path for supplying to the oil supply tank part of the lube oil flowed through the oil separator and the oil cooler.

3. The lube oil supply system according to claim 1, wherein the bearing oil supply system has a lube oil recovery path, and the bearings rotatably supporting the rotors are slide bearings each having a circumferential groove along inner periphery thereof for accumulating lube oil supplied to the bearings so that the lube oil accumulated in the groove is recovered to the lube oil recovery path.

4. The lube oil supply system according to claim 1, wherein the bearing oil supply system further includes a path that communicates a gas zone in an upper part in the oil supply tank to a position near the first inlet of the compressor for sucking fluid to be compressed, and a pressure regulator valve in the path.

5. A lube oil supply system for a screw compressor comprising:

a bearing oil supply system that supplies lube oil to bearings of the compressor at low pressure, wherein the bearing oil supply system includes a closed oil supply line with an oil supply tank, an oil cooler, and an oil supply pump;

a temperature control oil supply system that supplies the lube oil to the compressor at high pressure to control the temperature of fluid compressed by the compressor by contact with the lube oil, wherein the temperature control oil supply system includes a closed oil supply line with an oil separator and an oil cooler;

wherein the bearing oil system further includes a branch path downstream of the oil supply pump that returns the lube oil to the oil supply tank and a pressure regulator valve in the branch path; and a controller that controls opening of the pressure regulator valve based on a pressure difference between oil pressures downstream and upstream of the oil supply pump in the bearing oil supply system and on a pressure difference between discharge gas pressure in the temperature control oil supply system and the oil pressure downstream of the oil supply pump in the bearing oil supply system.

6. A lube oil supply system for a screw compressor comprising:

a bearing oil supply system that supplies lube oil to bearings of the compressor at low pressure, wherein the bearing oil supply system includes a closed oil supply line with an oil supply tank, an oil-level meter in the oil supply tank an oil cooler, and an oil supply pump;

a temperature control oil supply system that supplies the lube oil to the compressor at high pressure to control the temperature of fluid compressed by the compressor by contact with the lube oil, wherein the temperature control oil supply system includes a closed oil supply line with an oil separator and an oil cooler, wherein the bearing oil supply system includes a first path for recovering the lube oil supplied to the bearings of the compressor to the oil supply tank, and wherein the temperature control oil supply system includes a second path for supplying to the oil supply tank part of the lube oil flowed through the oil separator and the oil cooler;

a third path that returns the lube oil from the oil supply tank to the temperature control oil supply system, and a flow regulator valve in the third path, wherein the temperature control oil supply system further includes a flow regulator valve in the second path; and a controller that controls the oil level of the oil supply tank by controlling the flow regulator valves based on detected value of the oil-level meter.

7. A lube oil supply system for a screw compressor comprising:

a bearing oil supply system that supplies lube oil to bearings of the compressor at low pressure, wherein the bearing oil supply system includes a closed oil supply line with an oil supply tank, an oil cooler, and an oil supply pump;

a temperature control oil supply system that supplies the lube oil to the compressor at high pressure to control the temperature of fluid compressed by the compressor by contact with the lube oil, wherein the temperature control oil supply system includes a closed oil supply line with an oil separator and an oil cooler;

wherein the bearing oil supply system includes a first oath for recovering the lube oil supplied to the bearings of the compressor to the oil supply tank, and wherein the temperature control oil supply system includes a second oath for supplying to the oil supply tank part of the lube oil flowed through the oil separator and the oil cooler, wherein the bearing oil supply system further includes a branch path that bypasses the oil cooler provided in the bearing oil supply system, and a temperature control valve in the branch path to control the temperature of the lube oil supplied to the bearings by controlling opening of the temperature control valve.

8. The lube oil supply system according to claim 1, wherein the compressor has a balance piston, and the closed supply line of the bearing oil supply system includes a first oil supply line that supplies oil to the balance piston and a second oil supply line that supplies oil to the bearings, and a flow regulator valve in the second oil supply line.

9. The lube oil supply system according to claim 8, further including a control operator that controls pressure of oil to be supplied to the balance piston so that the oil pressure applies requisite counter force to the balance piston, wherein the requisite counter force is determined by calculating the thrust force exerting on one of the rotors based on the discharge gas pressure and suction gas pressure.

10. A method of lubricating a screw compressor having a slide valve, screw rotors, bearings for rotatably supporting the screw rotors, a first inlet for introducing gas to be compressed, and second and third inlets for separately introducing lube oil, the method comprising the steps of:

providing a bearing oil supply system that supplies lube oil to the bearings of the compressor at low pressure via the second inlet, wherein the bearing oil supply system includes a closed oil supply line with an oil supply tank, an oil cooler, and an oil supply pump;

providing a temperature control oil supply system that supplies the lube oil to the slide valve to supply the lube oil to the screw rotors at high pressure via the third inlet to control the temperature of compressed fluid being discharged from the compressor by contact with the lube oil, wherein the temperature control oil supply system includes a closed oil supply line with an oil separator and an oil cooler;

introducing the lube oil to the second inlet of the compressor to lubricate the bearings;

introducing the lube oil to the third inlet of the compressor to cool the compressed fluid;

increasing the temperature or decreasing the flow rate of the lube oil supplied to the third inlet; and cooling the lube oil supplied to the bearings of the compressor through the second inlet with the oil cooler to increase the viscosity thereof.

11. The method according to claim 10, wherein the bearing oil supply system further includes a path that communicates a gas zone in an upper part in the oil supply tank to a position near the first inlet of the compressor for sucking fluid to be compressed, and a pressure regulator valve in the path, the method further including the step of maintaining the gas zone at the same pressure as suction pressure of the compressor or intermediate pressure between suction and discharge pressure.

* * * * *